United States Patent [19]

Howard

[11] Patent Number: 5,043,683

[45] Date of Patent: Aug. 27, 1991

[54] WAVEGUIDE TO MICROSTRIPLINE POLARIZATION CONVERTER HAVING A COUPLING PATCH

[75] Inventor: Kevin R. Howard, Manchester, England

[73] Assignee: GEC-Marconi Limited, England

[21] Appl. No.: 369,616

[22] Filed: Jun. 21, 1989

[30] Foreign Application Priority Data

Jul. 8, 1988 [GB] United Kingdom ..... 8816276

[51] Int. Cl.[5] ..... H01P 1/17; H01P 5/107

[52] U.S. Cl. ..... 333/21 A; 333/26; 343/756; 343/786

[58] Field of Search ..... 333/26, 21 A, 33; 343/700 MS, 786, 778, 756, 769

[56] References Cited

U.S. PATENT DOCUMENTS

| | | | |
|---|---|---|---|
| 2,824,348 | 4/1958 | Kostriza et al. | 333/26 |
| 4,067,016 | 1/1978 | Kaloi | 343/700 MS |
| 4,453,142 | 6/1984 | Murphy | 333/26 |
| 4,486,758 | 12/1984 | de Ronde | 343/700 MS |
| 4,554,549 | 11/1985 | Fassett et al. | 343/769 X |
| 4,596,047 | 6/1986 | Watanabe et al. | 333/26 X |
| 4,716,386 | 12/1987 | Lait | 333/26 |
| 4,827,276 | 5/1989 | Fukuzawa et al. | 343/786 X |
| 4,873,529 | 10/1989 | Gibson | 343/700 MS |

FOREIGN PATENT DOCUMENTS

| | | | |
|---|---|---|---|
| 71069 | 2/1983 | European Pat. Off. | 343/700 MS |
| 2522885 | 9/1983 | France | 333/26 |
| 77403 | 4/1986 | Japan | 333/26 |
| 843042 | 6/1981 | U.S.S.R. | 333/21 A |
| 1062809 | 12/1983 | U.S.S.R. | 333/219 |
| 761790 | 11/1956 | United Kingdom . | |
| 1467728 | 3/1977 | United Kingdom . | |

OTHER PUBLICATIONS

Carven, K. and Mink, J.; "Microstrip Antenna Technology"; *IEEE Trans on Antennas and Propagation*; vol. AP-29, No. 1; Jan. 1981; pp. 16, 17.

*Primary Examiner*—Eugene R. LaRoche
*Assistant Examiner*—Benny T. Lee
*Attorney, Agent, or Firm*—Kirschstein, Ottinger, Israel & Schiffmiller

[57] ABSTRACT

A capacitively coupled printed patch (3) as a high efficiency device to couple orthogonally polarized energy between a microstripline (5) and a waveguide (1). Coupling between the microstripline (5) and the patch (3) is achieved by the microstripline terminating in a narrow strip probe (4), the end of which lies close to, but not in contact with, an edge of the patch (3). Two separate probes (4) arranged mutually orthogonally are used to effect independent polarized couplings to produce independent linear orthogonal signals or independent left- and right-handed circularly polarized signals. The microstriplines (5) and patch (3) are supported on a common substrate (8) which extends transversely through the waveguide (1). The waveguide wall has a quarter-wavelength thickness (T) so that its inner edge (10) appears continuous to energy passing through the substrate (8). One application is in a satellite TV receiving system where it is required to isolate two signals sharing a common channel but having orthogonal polarizations.

9 Claims, 2 Drawing Sheets

WAVEGUIDE TO MICROSTRIPLINE POLARIZATION CONVERTER HAVING A COUPLING PATCH

BACKGROUND OF THE INVENTION

1. Field of the Invention

This invention relates to each of two coupling arrangements and, in particular, to arrangements for coupling energy between a transmission line and a waveguide.

2. Description of Related Art

Coupling of energy between a transmission line and a waveguide is usually achieved by the use of one or more wire probes or loops inserted into the waveguide cavity through the wall of the waveguide, the probes lying transverse to its axis. In the case of a waveguide accommodating circular polarization, or, alternatively, two independent orthogonal polarisations, two such probes are required which must be mutually orthogonal within the cavity and spaced a half-wavelength apart (in the direction of the axis) if high isolation and a good return loss are to be achieved. The first probe would generally be spaced a quarter-wavelength from the short-circuit end of the waveguide. Such an arrangement has two disadvantages: firstly, the probes do not have the same frequency performance, the probe further from the short-circuit having a reduced bandwidth; and, secondly, the probes are not co-planar and hence are not suitable for direct connection to a single microstrip circuit board. Isolation between the two orthogonal polarisations is improved if the structure is deliberately detuned by moving the first probe closer to the short-circuit end of the waveguide. However, in the dual probe structure such detuning results in a seriously worsened return loss because the probes are no longer tuned to the cavity.

SUMMARY OF THE INVENTION

It is an object of the present invention to provide a waveguide structure in which both high isolation and good return loss can be achieved simultaneously for orthogonal polarisations.

According to the invention an arrangement for coupling energy between each of two transmission line and a waveguide comprises a conductive patch supported within and normal to the axis of the waveguide, with each transmission line extending transversely through the wall of the waveguide to positions providing coupling between each transmission line and the patch.

Each transmission line preferably extends to a position adjacent to, but not in contact with, the patch.

Each transmission line preferably comprises a microstripline section co-planar with the patch, the end portion of the microstripline section adjacent to the patch having reduced width.

Each transmission line may be one of two similarly arranged with respect to the patch, the two microstripline sections being disposed mutually orthogonally so as to accommodate within the waveguide mutually orthogonal plane polarized signals.

In one embodiment of the invention the transmission line comprises two microstripline branch sections extending from a junction toward the patch from orthogonal directions, means being provided to introduce a quadrature phase difference between signals carried by the branch sections, and thus accommodate a circularly polarized signal within the waveguide.

The means for introducing a quadrature phase difference may be constituted by the branch sections having different lengths.

Alternatively, the means for introducing a quadrature phase difference may be constituted by a hybrid network incorporated at the junction of the branch sections.

The hybrid network may be printed on a common substrate with the branch sections and the patch, the network lying external to the waveguide.

The hybrid network preferably has two first ports connected to the branch sections respectively, and two second ports connected to respective transmission lines.

The patch and the or each microstripline section may be supported on a substrate extending through the waveguide wall.

The wall thickness is preferably a quarter-wavelength at the operative frequency of the waveguide, so as to permit the substrate and the or each microstripline section to extend through the wall without detriment to the function of the waveguide.

BRIEF DESCRIPTION OF THE DRAWINGS

A coupling arrangement in accordance with the invention will now be described, by way of example, with reference to the accompanying drawings, of which.

DETAILED DESCRIPTION OF THE PREFERRED EMBODIMENTS

Figure 1A:
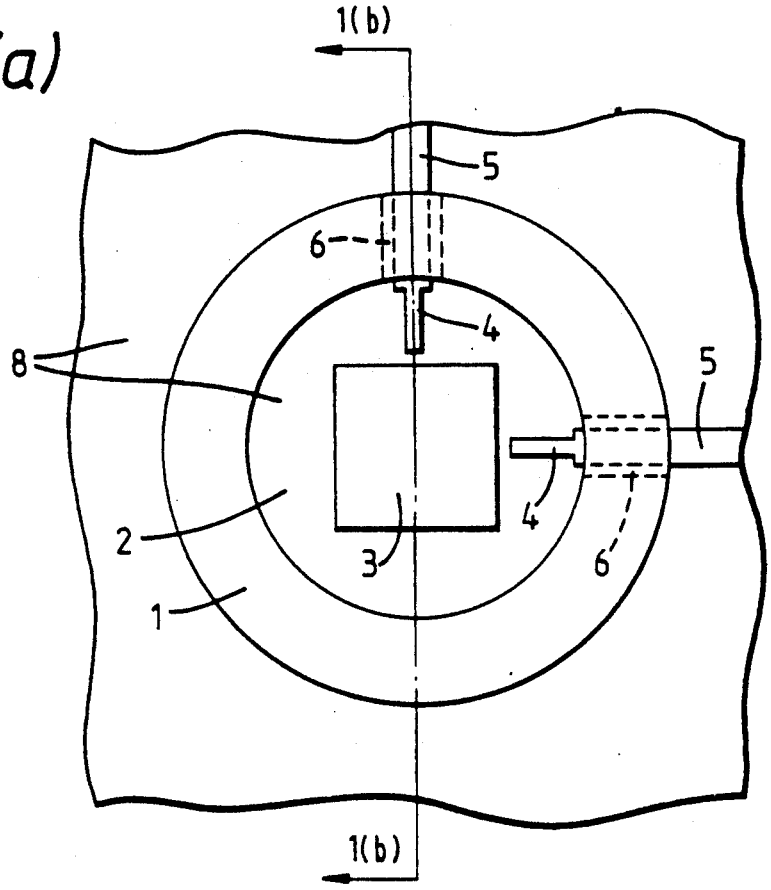
FIG. 1(*a*) shows an end view and FIG. 1(*b*) a sectioned side view taken on line of a waveguide coupling arrangement.
Figure 1B:
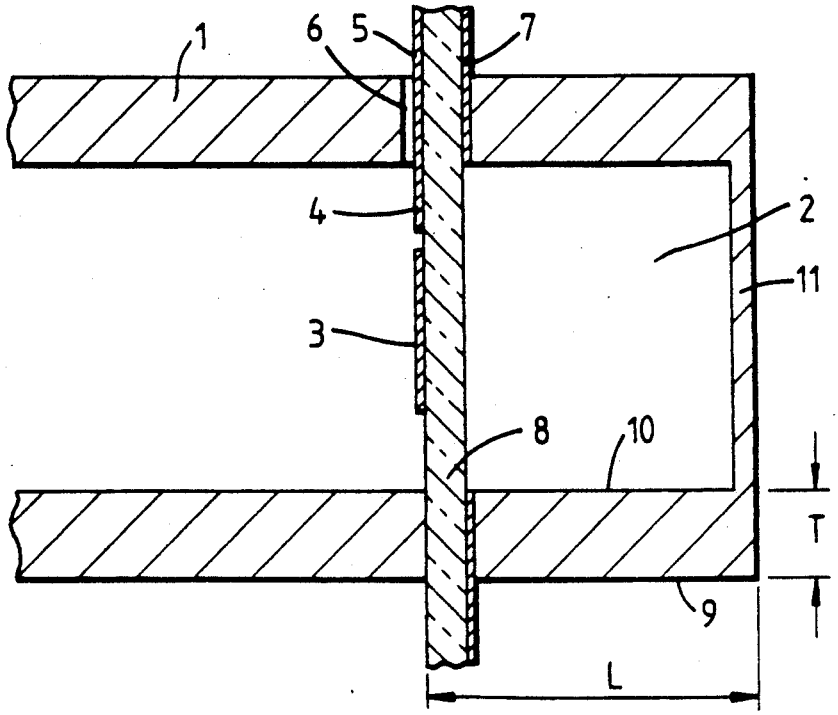

Referring to the drawings, FIGS. 1(*a*) and 1(*b*) show a standard waveguide structure in the form of a conductive tube 1 of circular section having a resonant cavity 2. A conductive patch 3, is supported within the cavity 2, transverse to the axis of the waveguide 1 by a dielectric substrate 8. Two microstripline sections 5 are printed on the substrate 8. Each microstripline section 5 is reduced in width at one end to a narrow conductive strip probe 4, the end of the probe lying adjacent to, but not in electrical contact with, an edge of the patch 3. The two strip probes 4 and their associated microstripline sections 5 lie mutually orthogonal, both co-planar with the patch 3. The substrate 8 extends through the whole circumference of the waveguide wall, i.e. it is sandwiched between two sections of the conductive tube 1. Each microstripline section 5 is isolated from the tube 1 by relieving the end face of the tube locally to form a channel 6 in the tube wall through which the microstripline section 5 extends without contacting said wall. Alternatively, an insulating washer may be sandwiched between the end face of the tube 1 and the side of the substrate 8 bearing the microstripline sections 5. The substrate 8 has a conductive around plane 7 on the side opposite the microstripline sections 5. The ground plane 7 is in contact with the waveguide wall, but does not extend within the cavity 2. Although in FIG. 1 the ground plane 7 is shown on the face of the substrate 8 closest to the short-circuit end 11 of the waveguide tube 1, it will be appreciated that the ground plane 7 may equally be provided on the opposing face of the substrate 8, the patch 3 and the microstripline sections 5 then being formed on the face nearest the short-circuit 11. The substrate 8 provides a convenient printed circuit board for mounting circuitry associated with the waveguide. For this reason, the substrate 8 and its ground plane 7 may extend substantially beyond the periphery of the waveguide.

The wall thickness T of the waveguide tube 1 is made a quarter-wavelength at the operative (i.e. tuned) frequency. At the discontinuity due to the substrate 8 the outer edge 9 of the tube 1 constitutes an open-circuit (or at least a very high impedance) to energy travelling through the substrate 8. By making T a quarter-wavelength this open circuit is transformed to an effective short-circuit at the inner edge 10 of the tube 1. Thus, at the tuned frequency, the inner edge 10 of the waveguide wall will appear continuous to signal energy, and the wall provides a choke that effectively enables the substrate to interrupt the waveguide wall without detriment to the waveguide function.

The gap between the end of the strip probe 4 and the edge of the patch 3 provides capacitive coupling of signal energy from the microstripline section 5 to the patch 3. The microstripline sections 5, with their associated strip probes 4, are capable of separately coupling signals to the waveguide to produce independent orthogonal polarisations with a high degree of isolation. If two such independent signals are to be accommodated within the waveguide, each microstripline section 5 will require its own transmission line (not shown), which may be a continuous extension of the microstripline section 5 in the form of a printed track on the substrate 8. Alternatively, the transmission lines may comprise coaxial cables, in which case a connector is required at the transition from the microstripline to the cable. The connector can be mounted as close to the waveguide as desired, provided the outer screen of the cable does not bridge the channel 6. The outer screen of the cable is connected to the ground plane 7 on the substrate 8.

The use of the conductive patch 3 as the coupling element ensures low loss and high isolation between the two polarisations. Loss is minimised because the energy propagating along the strip probes 4, once inside the waveguide, is mainly in air, i.e. no longer trapped between the microstripline and the ground plane. This means that most of the losses occur in the microstripline sections 5 which feed the strip probes 4. The substrate 8 within the waveguide serves only to support the patch 3 and the microstripline sections 5 and so should be as thin as practical to minimise losses further.

The substrate 8 is positioned a distance L (say, one-eighth of a wavelength) from the short-circuit end 11 of the waveguide 1 to deliberately detune the structure (FIG. 1(*b*)). This detuning improves isolation between the orthogonal polarisations. The incorporation of the patch 3 between the strip probes 4 maintains good return loss even when the cavity is detuned; hence both high isolation and good return loss can be achieved simultaneously.

Figure 2:
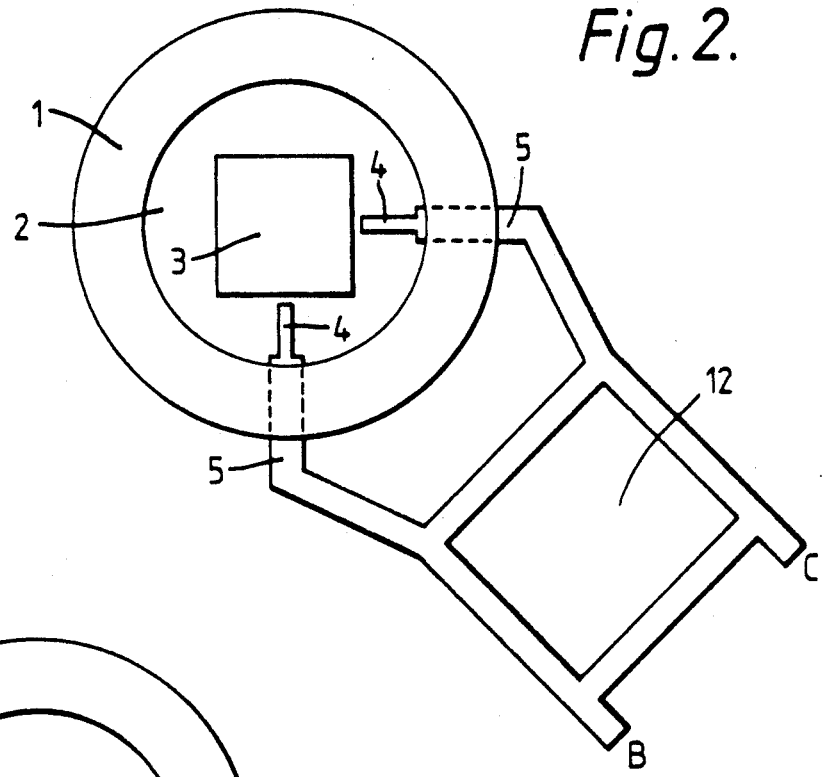
FIG. 2 shows a 90° hybrid network for use in the arrangement of FIG. 1 for coupling a circularly polarized signal.

Other orthogonal polarisations, such as circular polarisation, can be generated within the waveguide using the structure shown in FIG. 1. To achieve a circular polarisation, the signals applied at the strip probes 4 must have a quadrature phase difference in addition to their orthogonality in space. Such a phase difference can be achieved in a number of ways. FIG. 2 shows in outline one method of achieving circular polarisation by using a 90° hybrid network 12 between the microstripline sections 5 and a single transmission line (not shown), which may be connected to a point B or a point C. The hybrid network consists of a simple arrangement of signal paths, which may be conductive tracks etched on the same substrate 8 as supports the patch 3, but external to the waveguide. A signal applied to point B or point C by the transmission line reaches the strip probes 4 via two separate paths of different length. The difference in the path lengths is such that a 90° phase difference occurs between the signals coupled to the patch 3 by the two strip probes 4. A left-hand circular polarisation or a right-hand circular polarisation is generated is dependent upon whether the signal is applied to point B or point C.

Figure 3:
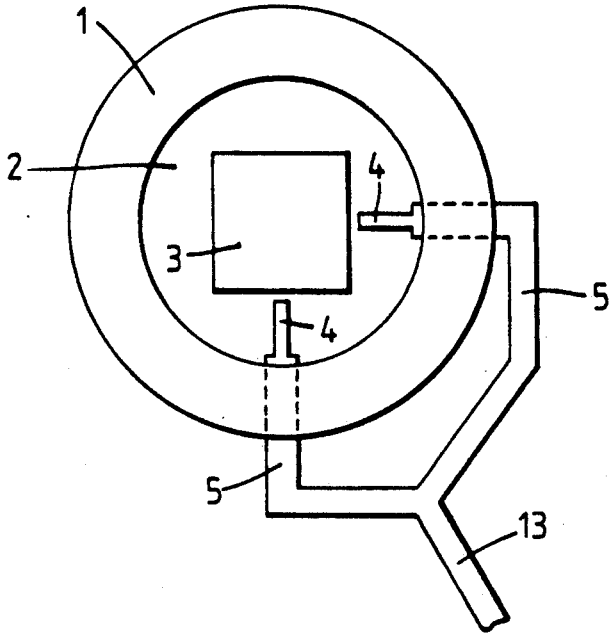
FIG. 3 shows an alternative feed network for one-coupling a circularly polarized signal.

An alternative method of coupling circular polarisation is illustrated in FIG. 3. Here a single microstrip transmission line 13 is divided into the two microstripling sections 5, which have different lengths to produce the required phase conditions. The hand of the circular polarisation is determined by the microstripline which provides the longer signal path.

Although the above description of embodiments has generally referred to applications in which the waveguide is used as a radiating element fed by one or two transmission lines, the coupling arrangements are equally suited to configurations for receiving polarized signals. One such application is in a DBS satellite TV receiving system where two broadcast signals sharing a common frequency channel may be isolated by virtue of their having independent orthogonal polarisations. The choice of programme may then be made without adjustment to the antenna by switching the transmission line carrying the desired signal to the receiver input.

I claim:

1. A coupling arrangement for coupling energy between each of two transmission lines and a waveguide, the arrangement comprising:

(A) a waveguide having a longitudinal axis, said waveguide having a short-circuit end, and (B) a microstripline circuit board having opposite main faces, said microstripline circuit board being disposed with said opposite main faces normal to said longitudinal axis and with a portion of said microstripline circuit board lying within said waveguide and spaced from said short-circuit end, (C) said microstripline circuit board comprising:

(i) a ground plane layer carried on one of said opposite main faces, said ground plane layer not extending into said waveguide, (ii) a first transmission line, said first transmission line extending into said waveguide and terminating at a first point within said waveguide, (iii) a second transmission line, said second transmission line extending into said waveguide and terminating at a second point within said waveguide, (iv) said first and second transmission lines being carried on the other of said opposite main faces and lying orthogonal to each other, and (v) a conductive patch, said conductive patch being carried on said other of the opposite main faces and disposed within said waveguide in a position adjacent to said first and second points without physically contacting said first and second transmission lines, for independent coupling of said transmission lines to said waveguide.

2. A coupling arrangement according to claim 1, each said transmission line having a width dimension transverse to the direction in which it extends and each said transmission line comprising a first portion having a first portion width dimension and a second portion having a second portion width dimension, said second portion lying within said waveguide and said second portion width dimension being smaller than said first portion width dimension.

3. A coupling arrangement according to claim 1, said microstripline circuit board further comprising a common transmission line, said first and second transmission lines being connected to said common transmission line at a junction point, said first transmission line having a first length dimension extending between said first point and said junction point, and said second transmission line having a second length dimension extending between said first length dimension and said second length dimension providing a quadrature phase difference between signals carried on said first and second transmission lines for coupling a circularly-polarized signal between said waveguide and said common transmission line.

4. A coupling arrangement according to claim 1, said microstripline circuit board further comprising a hybrid network and a third transmission line, said hybrid network having two first ports and two second ports, said two first ports being connected respectively to said first and second transmission lines, and said third transmission line being connected to one of said two second ports for coupling a circularly-polarized signal between said waveguide and said third transmission line, whether said circularly-polarized signal is a left-hand circularly-polarized signal or a right-hand circularly-polarized signal being determined by which one of said two second ports is connected to said third transmission line.

5. A coupling arrangement according to claim 1, wherein said waveguide comprises two longitudinal sections aligned co-axially with said longitudinal axis, one of said two longitudinal sections including said short-circuit end, said two longitudinal sections being respectively disposed on said opposite main faces of said microstripline circuit board so as to sandwich said microstripline circuit board.

6. A coupling arrangement for coupling energy between each of two transmission lines and a waveguide, said waveguide having an operative frequency, the arrangement comprising:

(A) a waveguide having a longitudinal axis, said waveguide comprising two longitudinal sections aligned coaxially with said longitudinal axis, one of said two longitudinal sections having a short-circuit end, and (B) a microstripline circuit board having opposite main faces, said microstripline circuit board being sandwiched between said two longitudinal sections with said opposite main faces normal to said longitudinal axis and spaced form said short-circuit end, (C) said waveguide including a wall having a thickness equivalent to a quarter-wavelength at said operative frequency to provide electrical continuity of the waveguide through said microstripline circuit board, (D) said microstripline circuit board comprising:

(i) a ground plane layer carried on one of said opposite main faces, said ground plane layer not extending into said waveguide, (ii) a first transmission line, said first transmission line extending into said waveguide and terminating at a first point within said waveguide, (iii) a second transmission line, said second transmission line extending into said waveguide and terminating at a second point within said waveguide, (iv) said first and second transmission lines being carried on the other of said opposite main faces and lying orthogonal to each other. and (v) a conductive patch, said conductive patch being carried on said other of the opposite main faces and disposed within said waveguide in a position adjacent to said first and second points without physically contacting said first and second transmission lines, for independent coupling of said transmission lines to said waveguide.

7. A coupling arrangement according to claim 6, each said transmission line having a width dimension transverse to the direction in which it extends and each said transmission line comprising a first portion having a first portion width dimension and a second portion having a second portion width dimension, said second portion lying within said waveguide and said second portion width dimension being smaller than said first portion width dimension.

8. A coupling arrangement according to claim 6, said microstripline circuit board further comprising a common transmission line, said first and second transmission lines being connected to said common transmission line at a junction point, said first transmission line having a first length dimension extending between said first point and said junction point. and said second transmission line having a second length dimension extending between ; said second point and said junction point, the difference between said first length dimension and said second length dimension providing a quadrature phase difference between signals carried on said first and second transmission lines for coupling a circularly-polarized signal between said waveguide and said common transmission line.

9. A coupling arrangement according to claim 6, said microstripline circuit board further comprising a hybrid network and a third transmission line, said hybrid network having two first ports and two second ports, said two first ports being connected respectively to said first and second transmission lines, and said third transmission line being connected to one of said two second ports for coupling a circularly-polarized signal between said waveguide and said third transmission line, whether said circularly-polarized signal is a left-hand circularly-polarized signal or a right-hand circularly-polarized signal being determined by which one of said two second ports is connected to said third transmission line.

* * * * *